United States Patent [19]

Troutner

[11] 3,947,309

[45] Mar. 30, 1976

[54] PITCHED WOODEN TRUSS WITH INTEGRAL RIDGE CONNECTOR

[75] Inventor: Arthur L. Troutner, Boise, Idaho

[73] Assignee: Trus Joist Corporation, Boise, Idaho

[22] Filed: Sept. 6, 1974

[21] Appl. No.: 503,958

Related U.S. Application Data

[62] Division of Ser. No. 352,102, April 18, 1973, abandoned.

[52] U.S. Cl. ..... 156/248; 156/268; 156/289; 144/309 L; 144/316

[51] Int. Cl.[2] B27M 1/08; B32B 31/18; B32B 31/20

[58] Field of Search ..... 156/250, 289, 248, 268, 156/90, 233, 344, 247, 267; 144/316, 317, 314 B, 315, 319, 309 L

[56] References Cited

UNITED STATES PATENTS

| | | | |
|---|---|---|---|
| 1,504,168 | 8/1924 | Viebrock et al. | 52/582 |
| 2,865,082 | 12/1958 | Gates | 29/25.3 |
| 3,215,579 | 11/1965 | Hagen | 156/289 |
| 3,732,137 | 5/1973 | Scher et al. | 156/289 X |
| 3,756,892 | 9/1973 | Mills et al. | 156/289 X |
| 3,818,832 | 6/1974 | Coale et al. | 156/289 X |

*Primary Examiner*—William A. Powell
*Assistant Examiner*—M. G. Wityshyn
*Attorney, Agent, or Firm*—Eugene D. Farley

[57] ABSTRACT

A pitched wooden truss comprises lower and upper chords interconnected by a plurality of web members. The upper chord includes two wooden sections arranged end to end at a predetermined angle to form a central ridge. The adjacent ends of the chord sections are formed with laterally offset, overlapped, convexly arcuate tongues and cooperating concavely arcuate recesses. Securing means secure the tongues to each other in overlapped position. Preferably, the adjacent ends of the chord sections comprise pieces of densified laminar wood.

4 Claims, 11 Drawing Figures

FIG. 1
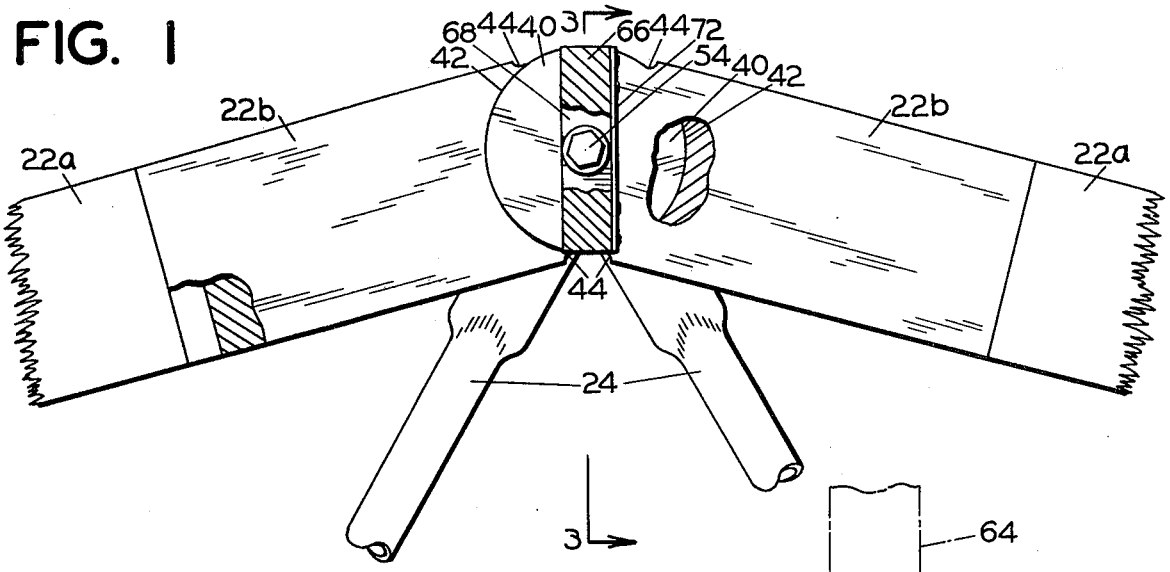
FIG. 2
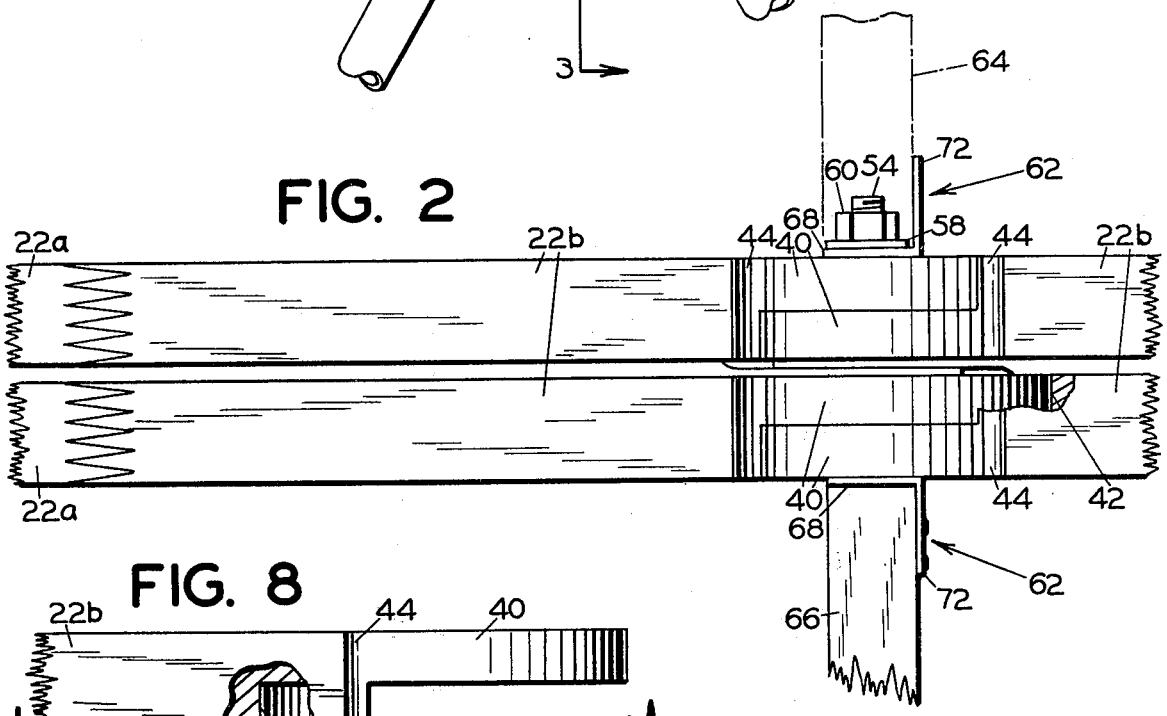
FIG. 8
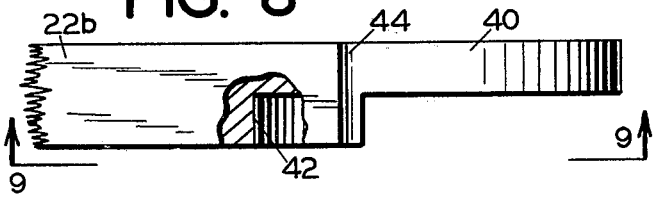
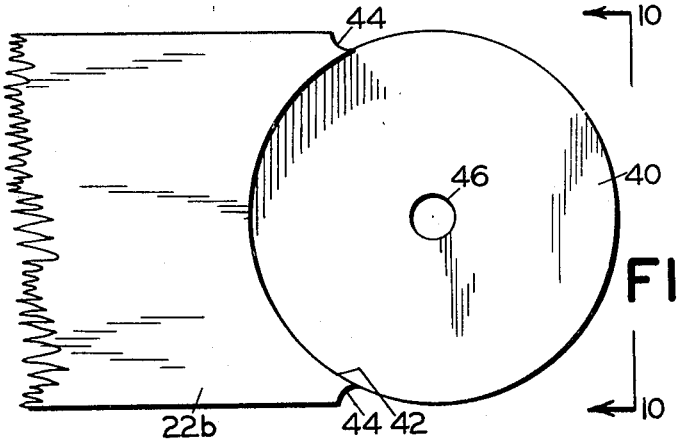
FIG. 9
FIG. 10
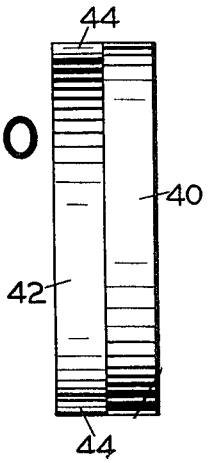

FIG. 4
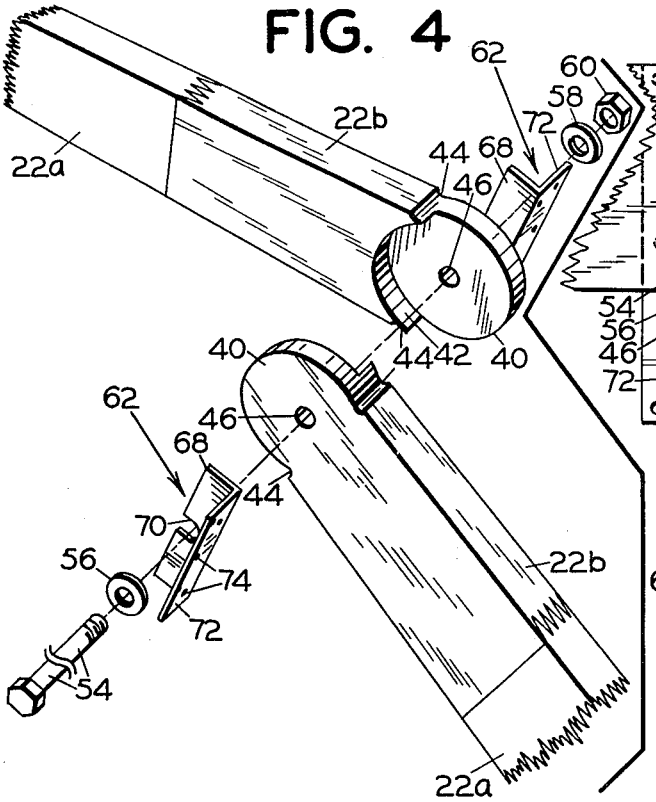
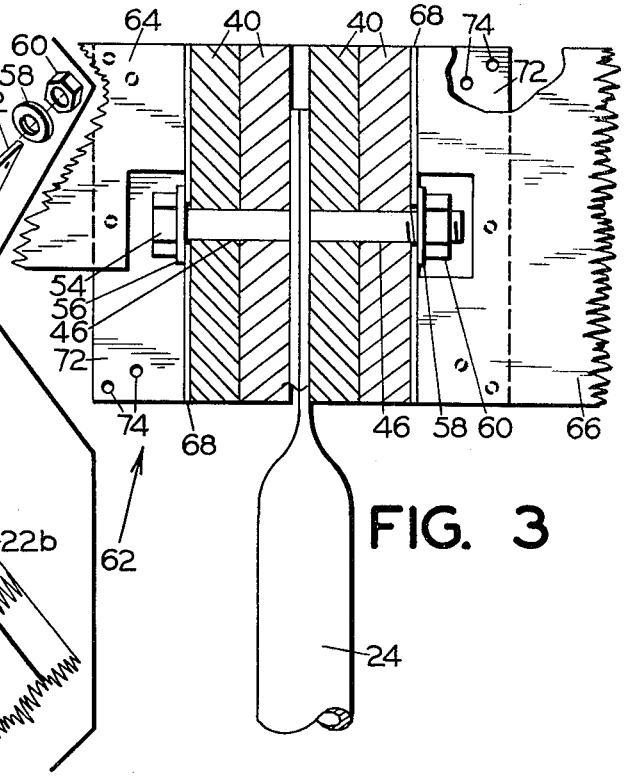
FIG. 3
FIG. 11
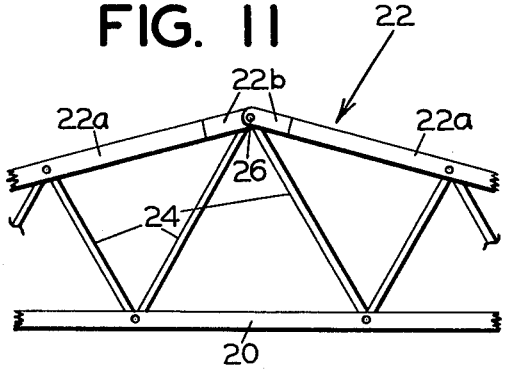
FIG. 7
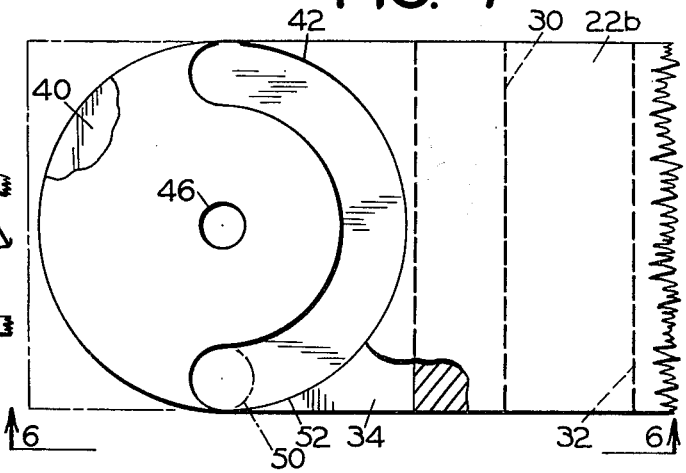
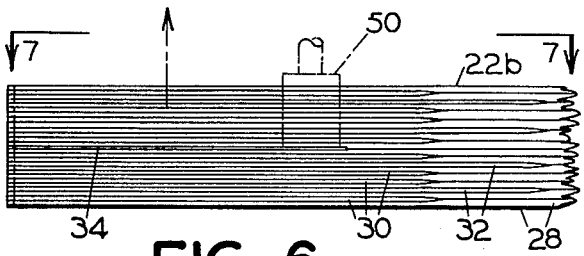
FIG. 6
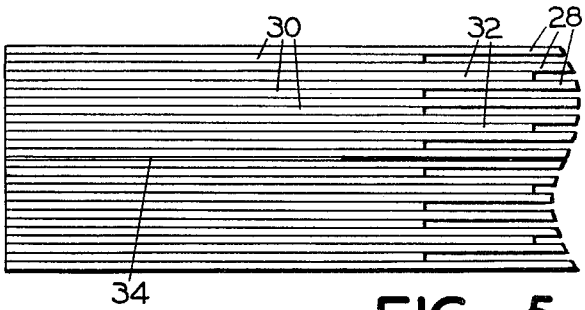
FIG. 5

PITCHED WOODEN TRUSS WITH INTEGRAL RIDGE CONNECTOR

This is a division of application Ser. No. 352,102, filed Apr. 18, 1973, and now abandoned.

This invention relates to pitched wooden trusses having integral ridge connectors. It also pertains to a method of making such trusses and related structural items.

One well known type of pitched structural wooden truss comprises a lower chord, a pitched upper chord including two sections arranged end to end at a predetermined angle to each other, and a plurality of web members interconnecting the upper and lower chords. The adjacent ends of the upper chord sections are coupled together at the desired angle by means of a ridge connector.

Conventionally the ridge connector comprises two metal parts bolted or otherwise secured to the ends of the chord sections and connected to each other. Illustrative of the application of metal ridge connectors of this class are those described and illustrated in my U.S. Pat. Nos. 3,457,689 and 3,535,845.

While useful for many purposes, pitched trusses having metal ridge connectors tend to be deficient in resistance to lateral forces and also to forces applied in tension. In addition, since the metal connectors usually are fastened to the wooden chord sections by means of bolts or spur-type fasteners, the wood is weakened correspondingly and tends to split under the heavy loads applied in building construction. Still further, the use of metal ridge connectors increases the cost of the trusses and the complexity of their manufacture.

Accordingly it is the general object of the present invention to provide a pitched wooden truss assembly having an integral ridge connector which will resist the various stresses, particularly lateral forces and tension stresses, which are applied to the truss during its manufacture, erection and use.

Other objects of the invention are the provision of a pitched wooden truss which is easily erected, which maintains the selected pitch, which lends itself to the incorporation of lateral bracing in the truss system, which is easily and inexpensively manufactured and assembled, and in which the connector adapts itself to pitches of various angles.

Still a further object of the invention is to provide a method for making components useful in the fabrication of pitched wooden trusses and kindred structural components.

Broadly considered, the presently described pitched truss assembly comprises a lower chord, a pitched upper chord including two wooden chord sections arranged end to end at a predetermined angle to each other to form a central ridge, and a plurality of web members interconnecting the chords. The adjacent ends of the upper chord sections are formed with laterally offset, overlapped, convexly arcuate tongues and mating concavely arcuate recesses. Securing means secure the tongues to each other in overlapped position with the tongues seated in the adjacent recesses.

Preferably, and necessarily in the case of most woods, the adjacent ends of the chord sections comprise densified laminar wood pieces, drilled, routed and trimmed to provide the tongues and recesses.

In compositing each laminar wood piece a metal foil or like sheet is included in the assembly and serves as a glue barrier. This permits easy separation at the metal sheet when the laminar product is routed or cut transversely to the plane of the metal sheet in the production of the offset tongue and adjacent recess.

In the drawings:

FIG. 1 is a fragmentary view in side elevation of the ridge portion of the hereindescribed pitched wooden truss with integral ridge connector, parts being broken away to show interior construction.

FIG. 2 is a fragmentary plan view of the truss.

FIG. 3 is a sectional view of the truss taken along line 3—3 of FIG. 1.

FIG. 4 is an exploded perspective view illustrating the manner of assembling the truss.

FIG. 5 is a fragmentary view in side elevation of a stacked laminar assembly used in the manufacture of the chord sections of the truss before consolidation.

FIG. 6 is a fragmentary view in side elevation of the stacked laminar assembly of FIG. 5 after consolidation, looking in the direction of the arrows of line 6—6 of FIG. 7.

FIG. 7 is a view in side elevation, looking in the direction of the arrows of line 7—7 of FIG. 6, illustrating the manner of working the end of the consolidated laminated assembly to produce an integral tongue and recess therein.

FIGS. 8, 9 and 10 are views in side elevation, plan, and end elevation respectively of the end of one of the chord sections of the presently described pitched wooden truss, made by the method illustrated in FIG. 7.

FIG. 11 is a fragmentary, schematic view in elevation of the truss.

As shown in FIG. 11, the hereindescribed pitched truss comprises a wooden lower chord 20, and a wooden upper chord 22 interconnected by a plurality of web members or links 24. Upper chord 22 is formed in two chord sections **22*a* arranged end to end with their adjacent ends interconnected by a ridge connector indicated schematically at 26.**

In order to provide upper chord terminal sections of adequate strength and hardness, advantage may be taken of the method described and illustrated in the co-pending patent application of Arthur L. Troutner, Ser. No. 247,897, filed Apr. 26, 1972 and issued June 4, 1974 as Pat. No. 3,831,842.

In accordance with the method therein described, each upper chord section **22*a* comprises a piece of dimension lumber such as a 2×4 or a 2×6 having an end segment 22*b*** of increased density. The end segment is attached end to end by finger jointing or other joining technique and provides a working section of increased hardness and strength.

End segments **22*b*** of the upper chord sections basically comprise an assembly of wood laminae glued face to face and pressed to the desired density.

The material employed in the practice of this method comprises a plurality of thin strips 28 of wood veneer, cut to size. A preferred stock for this purpose comprises conventional plywood veneer having a uniform thickness of, for example, 0.10, 0.125, 1.187, or 0.230 inches. It thus is possible to utilize veneers resulting from the plywood manufacturing operation.

The strips are precoated with a suitable adhesive which may comprise a conventional hot press glue applied in approximately the same spread as is employed in manufacturing plywood.

The wooden strips, precut to size and precoated with adhesive then are stacked continuously. In compositing the stack, strips 28 are arranged longitudinally, aligned with each other and lapped in number and pattern as required to produce a spliced structural chord of the desired length and density.

The desired degree of densification is achieved by the use of densifying laminae in the form of small wood pieces 30 and slightly longer pieces 32. These are inserted between strips 28 at spaced vertical intervals in a regular pattern achieving a desired transition from a highly densified part to a part of normal wood density.

To achieve optimum strength, the grain pattern is varied by arranging strips 28 and 30 with parallel grain and strips 32 with cross grain.

Thus it is possible to tailor the density and strength of the product to the desired levels. The greater the number of pieces in a given cross section, the greater the density. Arranging the laminae with parallel grain orients them properly to the direction of the force applied to the finished assembly. However, arranging the grain of the densifying laminae crosswise increases the bearing and tensile values of the densified region.

Also included in the assembly is a sheet 34 which provides a glue barrier, preventing the glue from migrating from one wood veneer to the adjacent one and providing a cleavage plane along which the final product may be separated, as will be described in detail hereinafter.

A variety of sheet materials may be used for this purpose. The foil of aluminum is a preferred material, although thin sheets of copper, steel or other metals may be employed if desired. Also, thin sheets of plastic may be used provided the plastic is not of such a character as to itself become adhesive under the conditions to which the assembly is subjected.

The assembly either is laid up in a press or is transferred thereto. Pressure is applied in a direction substantially perpendicular to the plane of the stack. The pressure thus applied is predetermined in magnitude to consolidate the interleaved portion to the thickness of the remaining portion and to apply to both portions clamping pressure sufficient adherently to unite the strips by setting of the glue interfaces therebetween.

Stated otherwise, pressure is applied sufficient to contact the strips outside the interleaved area and to bond them to each other. This contemporaneously compresses the strips in the interleaved areas to a fraction of their original thickness, for example to one-half their original thickness.

The consolidated piece then is divided into lengths and finger jointed to the ends of normal pieces of dimension lumber. This provides chord sections 22*a* with densified end segments 22*b*.

The upper chord sections may be used singly or, where a truss of particular strength is required, in tandem. The tandem application is illustrated in FIGS. 1, 2 and 3. This is adapted from the truss construction described and illustrated in Troutner U.S. Pat. No. 3,330,087.

As illustrated, there are employed in the hereindescribed pitched wooden truss two pairs of upper chord sections 22*a*. The components of each pair are arranged side by side in laterally spaced apart parallelism. The two pairs are arranged end to end and connected to lower joists not illustrated by means of connecting web members or links 24.

The adjacent densified ends of the opposed upper chord sections are interconnected by means of integral ridge connectors formed from the structure of the wood itself.

At the outer end of each densified section 22*b* there is formed a laterally offset, convexly arcuate tongue 40 on one side and a mating, concavely arcuate recess 42 on the other. When the two chord sections are arranged end to end, the tongue section of one seats in the recess of the other, and vice versa.

Relieved areas 44 are present at the points of juncture of convexly arcuate tongue 40 and the side margins of densified end piece 22*b*. A transverse perforation 46 is drilled through the center of each of the tongues. When the two tongues are overlapped, the two perforations register with each other.

A unique and effective method of shaping the end of the upper chord sections with integral tongues and companion recesses is illustrated in FIGS. 6 and 7. It takes advantage of the cleavage plane resulting from the presence of glue barrier 34 in the densified end of each piece.

In the practice of the method, perforation 46 is used as a mounting and pivot point for a router indicated schematically at 50, FIGS. 6 and 7. The router is set to the depth of barrier sheet 34. It then is swung through 180°, cutting an arc indicated at 52 of FIG. 7. This accomplishes two things.

First, it routs out a recess 42 on one side of the piece. Secondly, it severs the wood on this side so that the cut out portion falls away and is removed. This is possible because glue barrier 34 has prevented gluing together of the wood laminae which it separates.

Next, the end of the piece is trimmed in a 180° convexly arcuate contour. This provides tongue 40 on the side of the piece which is laterally offset from recess 42. As noted, this tongue is dimensioned for reception in recess 42 of a companion piece.

The manner of assembling two of the upper chord sections fabricated in the foregoing manner is illustrated in FIG. 4.

The two upper chord sections are arranged end to end and placed with tongues 40 face to face, with openings 46 registering. In this position the tongues enter and seat in corresponding recesses 42. Securing means next are applied to hold the two pieces connected to each other.

In the illustrated form of the invention, the securing means comprise pin means, specifically a bolt 54 with washers 56, 58 and nut 60. The bolt is inserted through both of the openings, the two chord sections adjusted to the appropriate angle, as by attaching their outer ends to lower chord 20, and the bolt tightened down.

It is to be noted that the construction of the connector is such as to accommodate a wide range of ridge angles. Normally, such angles fall in the range of 140 to 180°. Reliefs 44 make it possible to achieve the extreme angles by providing recesses for the leading edges of the two chord sections.

The hereindescribed integral ridge connector also makes possible the inclusion of means for stabilizing the structure in which the trusses are incorporated by bracing the trusses laterally.

To this end there are provided angular brackets or clips indicated generally at 62. These support cross braces 64 and 66 which extend substantially normal to the trusses and span the distance between trusses, stabilizing them in the lateral direction. Like the chord components, stabilizing pieces 64, 66 also may comprise pieces of commercial dimension lumber, pieces 64 comprising a 2×4 and piece 66 a 2×6 in the illustrated arrangement.

Bracket 62 basically comprises an angular member such as a piece of angle iron having one side 68 which contains a slot 70 and another side 72 at substantially right angles to the first side and characterized by having a plurality of nail holes 74.

In the use of the bracket, slot 70 is slipped over bolt 54 before the latter is tightened down. The bolt then clamps the bracket in place. Braces 64, 66 then are secured to side 72 of the bracket by means of nails.

Where the double truss construction of FIGS. 1, 2 and 3 is employed in heavy duty installations, it is assembled in a similar manner, using instead of the single chord sections illustrated in FIG. 4 two chord sections lying side by side and employing a bolt 54 of sufficient length to accommodate the double thickness.

It thus will be apparent that by the present invention I have provided a pitched wooden truss with an integral ridge connector which achieves the purposes of the invention in that the truss is stable, resistant to applied stresses in tension and compression, and to forces of lateral displacement. It is versatile in that it may be applied to trusses of various designs having ridges of varied angle.

It is simple and easily put together using a single bolt. The integral connector parts may be fabricated by a simple machining operation. Even though made of wood, the truss resists cracking and splintering under load first, because of the high density and great strength of the wood parts of the connector and second, because of the freedom from the plurality of nail screw or bolt holes which characterize the application of the prior art metal ridge connectors.

Having thus described my invention in preferred embodiments, I claim:

1. The method of making a structural wood product which comprises:

a. providing a plurality of wood laminae, b. applying glue to the faces of the laminae, c. laying the laminae face to face to form a stacked assembly, d. including between confronting end portions only of selected laminae of the assembly a glue-impervious barrier sheet, e. pressing the assembly and permitting the glue to set, and f. cutting across a side face of said end portion of the resulting glued laminate to the plane of the barrier sheet, thereby cleanly separating the cut-away portion only of the laminate from the body thereof.

2. The method of claim 1 including the step of contemporaneously consolidating the assembly while pressing it.

3. The method of claim 1 wherein the step of cutting across a side face of the resulting glue laminate comprises routing out the side face to form a concavely arcuate recess on one side of the chord section while leaving an outwardly projecting tongue on the other side thereof.

4. The method of claim 3 including the step of cutting off the outer end of the tongue in convexly arcuate outline to provide a tongue dimensioned to seat in the concavely arcuate recess in a companion laminate.

* * * * *